US007090547B2

(12) United States Patent
Machida et al.

(10) Patent No.: US 7,090,547 B2
(45) Date of Patent: Aug. 15, 2006

(54) MALE BAR-LIKE CONNECTION TERMINAL AND METHOD OF PRODUCING THE SAME

(75) Inventors: Yukifumi Machida, Tokyo (JP); Yoshikazu Tanaka, Tokyo (JP); Hiroshi Ikagawa, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 10/518,117

(22) PCT Filed: Jul. 10, 2003

(86) PCT No.: PCT/JP03/08775

§ 371 (c)(1),
(2), (4) Date: May 18, 2005

(87) PCT Pub. No.: WO2004/012303

PCT Pub. Date: Feb. 5, 2004

(65) Prior Publication Data

US 2006/0057901 A1 Mar. 16, 2006

(30) Foreign Application Priority Data

Jul. 30, 2002 (JP) ..... 2002-221169

(51) Int. Cl.
*H01R 4/18* (2006.01)

(52) U.S. Cl. ..... 439/866; 439/825; 439/884; 439/877

(58) Field of Classification Search ..... 439/866, 439/825, 884, 877
See application file for complete search history.

(56) References Cited

U.S. PATENT DOCUMENTS

| | | | | |
|---|---|---|---|---|
| 6,077,131 | A * | 6/2000 | Fukuda et al. | 439/884 |
| D454,545 | S * | 3/2002 | Hayashi et al. | D13/154 |
| 6,375,521 | B1 * | 4/2002 | Tachi et al. | 439/884 |
| 6,659,813 | B1 * | 12/2003 | Sai | 439/884 |
| 6,790,106 | B1 * | 9/2004 | Ito et al. | 439/884 |

FOREIGN PATENT DOCUMENTS

| | | |
|---|---|---|
| JP | 40-26788 B1 | 11/1965 |
| JP | 41-17259 B1 | 9/1966 |
| JP | 9-223532 A | 8/1997 |
| JP | 11-329545 A | 11/1999 |
| JP | 2004-063318 | 2/2004 |

* cited by examiner

*Primary Examiner*—Tulsidas C. Patel
*Assistant Examiner*—Harshad Patel
(74) *Attorney, Agent, or Firm*—Frishauf, Holtz, Goodman & Chick, P.C.

(57) ABSTRACT

Even in the case of a bar-like small terminal connection, its strength is retained. In (a), a strip (21) made, for example, of a thin metal sheet having a thickness of 0.2 mm and a predetermined width is collapsed by rolling to a thickness of 0.16 mm as in (b). Subsequently, as in (c), the longitudinal opposite sides (22, 23) of the strip (21) are erected with respect to the base plate (24), then inwardly bent, as in (d), and folded onto the base (24), as in (e). Further, the folded opposite sides (22, 23) are erected together with the base plate (24) into a closely contacted state, whereupon as in (f), the folded body is mechanically compressed from all sides into a form having a 0.64-mm square cross section.

3 Claims, 3 Drawing Sheets

MALE BAR-LIKE CONNECTION TERMINAL AND METHOD OF PRODUCING THE SAME

This application is a U.S. National Phase Application under 35 USC 371 of International Application PCT/JP2003/008775 filed Jul. 10, 2003.

TECHNICAL FIELD

The present invention relates to a male type rod-like connecting terminal of an electric connector, which is engaged with a corresponding female type connecting terminal of the electric connector, and also relates to a method of manufacturing such a male type rod-like connecting terminal.

TECHNICAL BACKGROUND

In recent years, with the increase in an amount of information to be treated by various kinds of electric equipments, a smaller and more compact electric connector has been desired and, thus, a male type connecting terminal of a smaller size has been required. For this requirement, a tip portion of a male type connecting terminal with a square cross section having a side of 0.64 mm has been developed as a standard male type connecting terminal.

A small male type rod-like connecting terminal of this kind is disclosed in JPA 11-329545, in which a tip portion has a rectangular cross section. FIG. 5 shows this known male type rod-like connecting terminal while a portion thereof has been dispensed with for the sake of clarity. The connecting terminal 1 is integrally formed by bending a thin conductive metal plate and includes a rod-like terminal connecting portion 2 which is to be electrically coupled with a corresponding female type connecting terminal. The connecting terminal further includes a U-shaped wire clamping portion to which is clamped an electric wire extending in an opposite direction to the terminal connecting portion 2.

In the known male type connecting terminal, the connecting terminal portion 2 has a hollow cylindrical shape as illustrated in FIG. 6. That is to say, the connecting terminal portion 2 is formed by bending a metal plate to have a given thickness.

The above mentioned terminal connecting portion 2 of the male type rod-like connecting terminal 1, however, is relatively delicate against force and vibration added up and down and, moreover, has such a drawback that it might be bent and in an extreme case, might be broken at a root portion of the terminal connecting portion 2 when strong force and vibration are continuously applied, because the terminal portion is relatively flat and metal plates standing side by side are limited in number and in width.

In addition, upon forming a hollow portion by bending a metal plate, a cost of manufacturing a mold becomes expensive especially for a super-small connecting terminal.

It is an object of the present invention to provide a male type rod-like connecting terminal, in which the above mentioned problems can be removed and a mechanical strength of a terminal connecting portion can be increased, even though the connecting terminal having a very small size is formed by bending a thin metal plate.

It is another object of the present invention to provide a method of manufacturing the above mentioned male type rod-like connecting terminal.

DISCLOSURE OF THE INVENTION

In order to attain the aforesaid objects, according to the present invention, a male type rod-like connecting terminal of an electrical connector comprises a rod-like terminal connecting portion provided at a front end of the connecting terminal, said rod-like terminal connecting portion being connected to a corresponding female type connecting terminal of the electrical connector, and a wire clamping portion provided at a rear end of the connecting terminal, to said wire clamping portion an electric wire being to be connected, said rod-like connecting terminal being formed by bending and folding an electrically conductive metal plate, characterized in that said rod-like terminal connecting portion is consisting of a rod-like member having a substantially square cross section, said rod-like member being formed by bending upwardly both lateral sides of a strip portion of the electrically conductive metal plate to form raised portions, folding inwardly both upper ends of the raised portions, and folding upwardly both the raised portions such that the raised portions are closely contacted with each other.

According to further aspect of the present invention, a method of manufacturing a male type rod-like connecting terminal of an electrical connector including a rod-like terminal connecting portion provided at a front end of the connecting terminal, said rod-like terminal connecting portion being to be connected to a corresponding female type connecting terminal of the electrical connector, and a wire clamping portion provided at a rear end of the connecting terminal, to said wire clamping portion an electric wire being to be connected, said rod-like connecting terminal being formed by bending and folding an electrically conductive metal plate, comprises:

bending upwardly both lateral sides of a strip portion of the metal plate from a base portion of the strip portion to form raised portions;

folding said raised portions inwardly toward the base portion of the strip portion;

folding the base portion of the strip portion such that said raised portions are closely contacted with each other; and compressing a whole portion of the connecting terminal portion to have a substantially square cross section with a given dimension.

BEST MODE OF THE INVENTION

Figure 1:
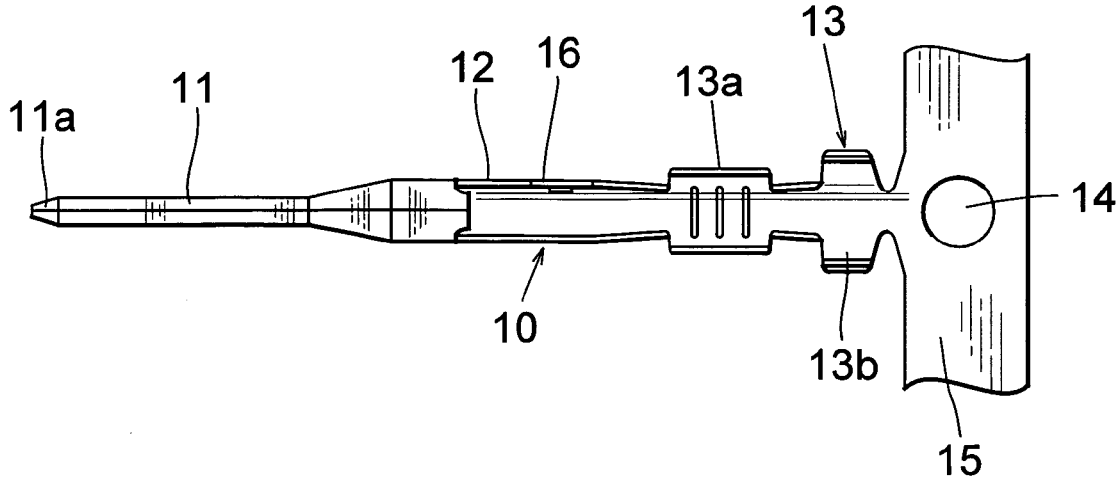
FIG. 1 is a plan view of a male type rod-like connecting terminal according to the invention.
Figure 2:
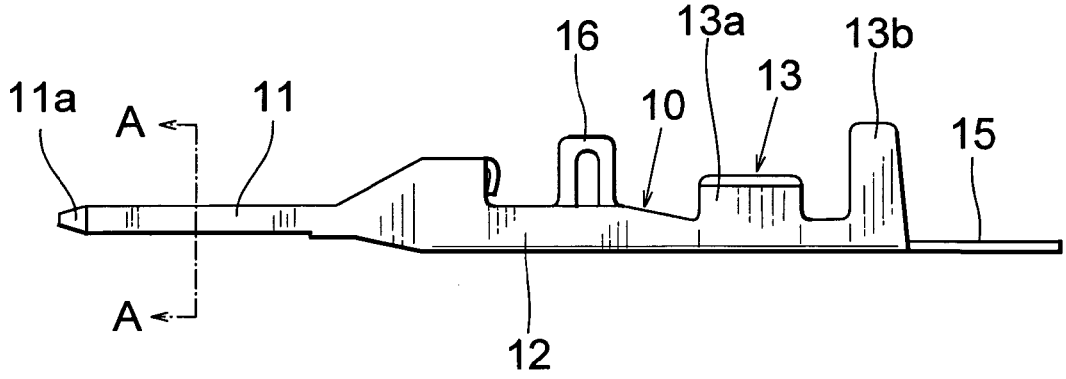
FIG. 2 is a side view of the male rod-like connecting terminal.
Figure 3:
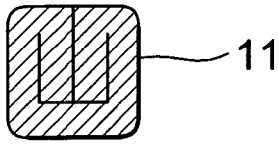
FIG. 3 is an enlarged cross sectional view cut along an A—A line in FIG. 2.

FIG. 1 is a plan view and FIG. 2 is a side view showing an embodiment of the male type rod-like connecting terminal according to the present invention, and FIG. 3 is an enlarged cross sectional view cut along an A—A line in FIG. 2.

The male type rod-like connecting terminal 10 of an electrical connector is formed by punching a thin electrically conductive metal plate into a given pattern and by folding the metal plate such that the male type rod-like connecting terminal 10 includes a rod-like terminal connecting portion 11 which is provided at a front end and is to be connected to a corresponding female type connecting terminal of the electrical connector, a medium portion 12 for securing the connecting terminal to a housing of the electrical connector and a wire clamping portion 13 having a U-shape cross section for connecting an electric wire. The wire clamping portion 13 is connected to a connecting strip 15 including pilot holes 14, which serve as a positional standard for molding the connecting terminal with the aid of a forming press and connecting the electric wire.

The wire clamping portion 13 includes a core conductor clamping portion 13*a* for clamping a core conductor of the electric wire and a sheath clamping portion 13*b* for clamping a sheath of the electric wire. Here, a reference numeral 16 denotes a stabilizer for keeping a stable posture of the connecting terminal 10 upon accommodating the connecting terminal in the housing.

The terminal connecting portion 11 is formed to have a square cross section by folding lateral sides of a strip portion along the longitudinal direction, said strip portion being formed in an electrically conductive metal plate by punching, and a tip 11*a* of the connecting terminal is processed into a square corn shape by compression molding.

Figure 4:
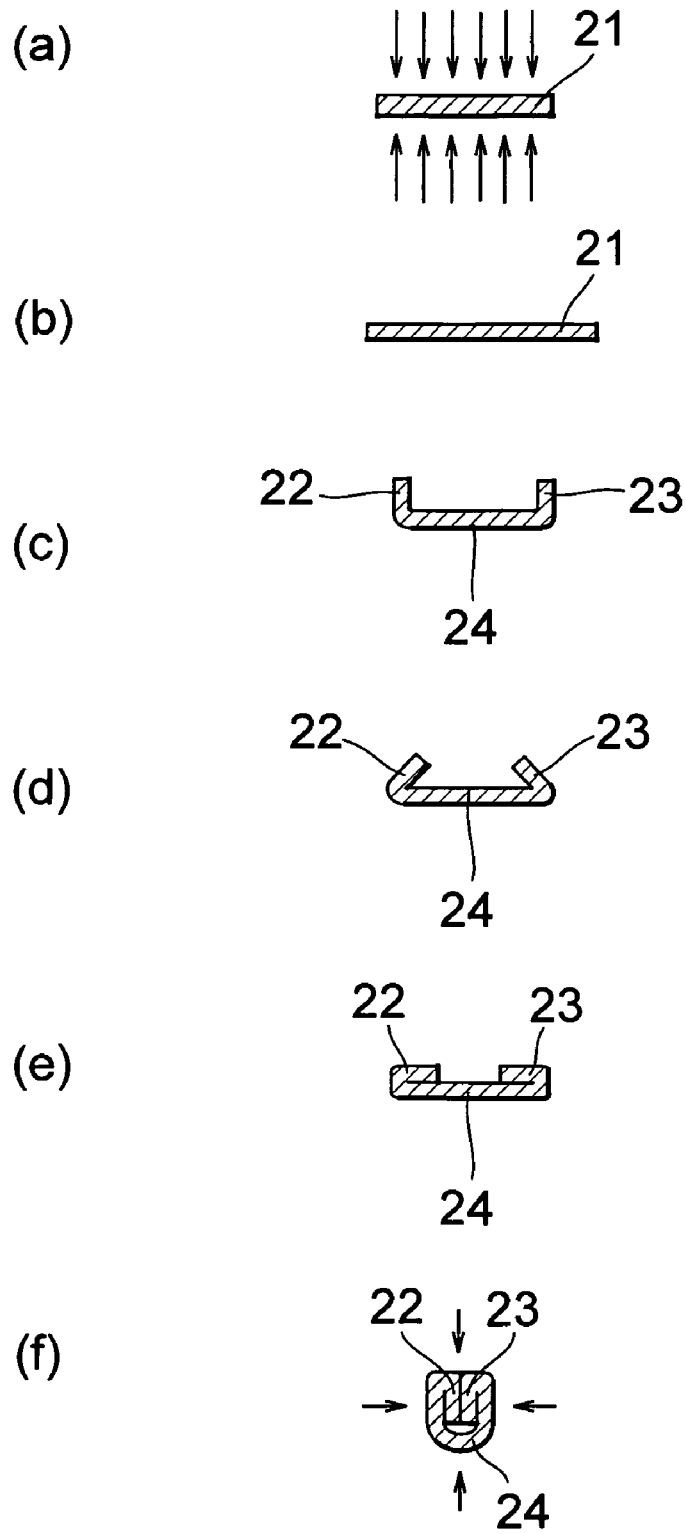
FIG. 4 is an explanatory view showing a molding process.
Figure 5:
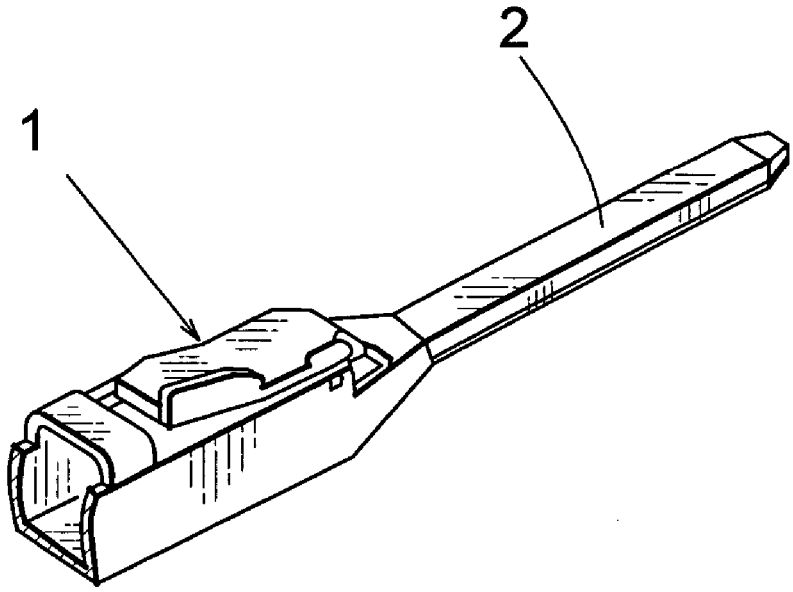
FIG. 5 is a perspective view of a conventional male type rod-like connecting terminal.
Figure 6:
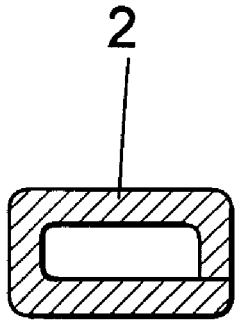
FIG. 6 is a cross sectional view of a terminal connecting portion of the conventional male type rod-like connecting terminal.

FIG. 4 is an explanatory view illustrating successive molding processes for forming the terminal connecting portion 11. As shown in FIG. 4(*a*), a strip portion 21 having a given width of a thin metal plate having a thickness of, for example 0.2 mm is pressed by rolling into a thickness of 0.16 mm as depicted in FIG. 4(*b*). After that, both lateral side portions 22, 23 of the strip portion 21 extending in the longitudinal direction are raised from a base portion 24 as shown in FIG. 4(*c*), and the thus raised side portions 22, 23 are bent inwardly toward the base portion 24 as shown in FIG. 4(*d*) such that the side portions 22, 23 are folded on the base portion 24 as illustrated in FIG. 4(*e*).

Furthermore, the thus folded both lateral side portions 22, 23 are raised together with the base portion 24 as shown in FIG. 4(*f*) such that the both lateral side portions are closely contacted with each other. Finally, the thus folded body is compressed by mechanical compression applied from all directions to have a square cross section having a side of 0.64 mm as shown FIG. 3.

It should be noted that in a final product, the base portion 24 may be slightly inflated downward as illustrated in FIG. 4(*f*).

When an electrically conductive metal plate with a thickness of 0.19 mm is used from the beginning, the rolling process shown in FIG. 4 (*a*) can be dispensed with. Also in this case, the terminal connecting portion has to be compressed to have a square cross section with a sided of 0.64 mm by the process depicted in FIG. 4(*f*).

According to the present invention, the terminal connecting portion 11 of the male type rod-like connecting terminal 10 is formed by folding a thin electrically conductive metal plate such that the terminal connecting portion 11 has no hollow portion and is formed into the rod-like member with a square cross section having a sufficient width in a vertical direction, and therefore the terminal connecting portion 11 thus produced can have thicker sides even though the starting material, i.e. the electrically conductive metal plate is very thin and the connecting terminal is hardly bent vertically or broken.

APPLICABILITY IN THE INDUSTRIAL FIELD

As explained above, in the male type rod-like connecting terminal and the method of manufacturing the same according to the invention, the terminal connecting portion is formed by bending and folding an electrically conductive metal plate into the rod-shape with a substantially square cross section, and thus a mechanical strength of the terminal connecting portion can be improved especially in the vertical direction.

What is claimed is:

1. A male type rod-like connecting terminal of an electrical connector comprising a rod-like terminal connecting portion provided at a front end of the connecting terminal, said rod-like terminal connecting portion being connected to a corresponding female type connecting terminal of the electrical connector, and a wire clamping portion provided at a rear end of the connecting terminal, to said wire clamping portion an electric wire being to be connected, said rod-like connecting terminal being formed by bending and folding an electrically conductive metal plate, characterized in that said terminal connecting portion is consisting of a rod-like member having a substantially square cross section, said rod-like member being formed by bending upwardly both lateral sides of a strip portion of the electrically conductive metal plate to form raised portions, folding inwardly both upper ends of the raised portions and folding upwardly both the raised portions such that four layers of the metal plate are stacked in a lateral direction and the raised portions are closely contacted with each other without producing any space within the terminal connecting portion.

2. The male type rod-like connecting terminal according claim 1, wherein a front end of said terminal connecting portion is pressed into a projected shape.

3. A method of manufacturing a male type rod-like connecting terminal of an electrical connector including a rod-like terminal connecting portion provided at a front end of the connecting terminal, said rod-like terminal connecting portion being to be connected to a corresponding female type connecting terminal of the electrical connector, and a wire clamping portion provided at a rear end of the connecting terminal, to said wire clamping portion an electric wire being to be connected, said rod-like connecting terminal being formed by bending and folding an electrically conductive metal plate, comprising:

bending upwardly both lateral sides of a strip portion of the metal plate from a base portion of the strip portion to form raised portions;

folding said raised portions inwardly toward the base portion of the strip portion;

folding the base portion of the strip portion such that four layers of the metal plate are stacked in a lateral direction and said raised portions are closely contacted with each other without producing any space within the terminal connecting portion; and compressing a whole portion of the connecting terminal portion to have a substantially square cross section with a given dimension.

* * * * *